US008859095B2

(12) United States Patent
Nishida et al.

(10) Patent No.: US 8,859,095 B2
(45) Date of Patent: Oct. 14, 2014

(54) HIGH-CARBON STEEL WIRE ROD EXHIBITING EXCELLENT WORKABILITY

(75) Inventors: Seiki Nishida, Tokyo (JP); Nariyasu Muroga, Tokyo (JP); Hitoshi Demachi, Tokyo (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 543 days.

(21) Appl. No.: 13/131,681

(22) PCT Filed: Nov. 4, 2010

(86) PCT No.: PCT/JP2010/069597

§ 371 (c)(1),
(2), (4) Date: May 27, 2011

(87) PCT Pub. No.: WO2011/055746

PCT Pub. Date: May 12, 2011

(65) Prior Publication Data

US 2011/0229718 A1 Sep. 22, 2011

(30) Foreign Application Priority Data

Nov. 5, 2009 (JP) ..... P2009-254172

(51) Int. Cl.

| | |
|---|---|
| ***B32B 15/00*** | (2006.01) |
| ***C21D 8/06*** | (2006.01) |
| ***C22C 38/04*** | (2006.01) |
| ***C22C 38/18*** | (2006.01) |
| ***C22C 38/02*** | (2006.01) |

(52) U.S. Cl.

CPC ..... *C22C 38/02* (2013.01); *C21D 2211/009* (2013.01); *C21D 8/06* (2013.01); *C22C 38/04* (2013.01); *C22C 38/18* (2013.01); *C21D 2211/005* (2013.01)

USPC ..... 428/379; 148/330; 148/320; 428/364

(58) Field of Classification Search

None

See application file for complete search history.

(56) References Cited

U.S. PATENT DOCUMENTS 4,375,378 A * 3/1983 Ohtani et al. ..... 148/596
5,725,689 A * 3/1998 Nishida et al. ..... 148/320

(Continued)

FOREIGN PATENT DOCUMENTS

CN 101086052 A 12/2007
EP 2 034 036 A2 3/2009

(Continued)

OTHER PUBLICATIONS

JP2005281793 A, Oct. 2005, machine translation.*

(Continued)

*Primary Examiner* — Jill Gray

(74) *Attorney, Agent, or Firm* — Birch, Stewart, Kolasch & Birch, LLP

(57) ABSTRACT

Provided is a wire rod contains, in mass %: C: 0.6 to 1.1%; Si: 0.1 to 0.5%; Mn: 0.2 to 0.6%; S: 0.004 to 0.015%; and, Cr: 0.02 to less than 0.05%; with a balance including Fe and inevitable impurities in which P is limited to 0.02% by mass or lower and Al is limited to 0.003% by mass or lower; the wire rod has a pearlite in a surface thereof; and, the wire rod has, in a peripheral portion in a cross section thereof, a {110} crystal plane of ferrite in the pearlite, an accumulation degree of the crystal plane being 1.2 or more.

6 Claims, 5 Drawing Sheets

(56) References Cited

U.S. PATENT DOCUMENTS

| | | | | |
|---|---|---|---|---|
| 6,447,622 | B1 * | 9/2002 | Yamada et al. | 148/320 |
| 8,168,011 | B2 * | 5/2012 | Yamasaki et al. | 148/330 |
| 8,308,875 | B2 * | 11/2012 | Yamasaki et al. | 148/330 |
| 2006/0289402 | A1 * | 12/2006 | Kimura et al. | 219/121.44 |
| 2007/0277913 | A1 | 12/2007 | Kochi et al. | |
| 2009/0087336 | A1 | 4/2009 | Nishida et al. | |
| 2009/0277545 | A1 * | 11/2009 | Yamasaki et al. | 148/598 |
| 2010/0212786 | A1 * | 8/2010 | Yamasaki et al. | 148/595 |
| 2011/0229718 | A1 * | 9/2011 | Nishida et al. | 428/379 |

FOREIGN PATENT DOCUMENTS

| | | | | | |
|---|---|---|---|---|---|
| JP | 2-213448 | A | | 8/1990 | |
| JP | 11-172332 | A | | 6/1999 | |
| JP | 2003-82434 | A | | 3/2003 | |
| JP | 2005-281793 | A | | 10/2005 | |
| JP | 2005281793 | A | * | 10/2005 | C21D 8/06 |
| JP | 2006-28619 | A | | 2/2006 | |
| JP | 2007-217790 | A | | 8/2007 | |
| JP | 2008-57008 | A | | 3/2008 | |
| JP | 2009-62574 | A | | 3/2009 | |
| JP | 2010-222630 | A | | 10/2010 | |
| WO | WO 2007/139234 | A1 | | 12/2007 | |

OTHER PUBLICATIONS

International Search Report, dated Jan. 25, 2011, issued in PCT/JP2010/069597.

Chinese Office Action mailed Jul. 20, 2012 issued in Chinese Patent Application No. 201080003183.2 (English translation is attached).

* cited by examiner

HIGH-CARBON STEEL WIRE ROD EXHIBITING EXCELLENT WORKABILITY

TECHNICAL FIELD

The present invention relates to a high-carbon steel wire rod manufactured by hot rolling and exhibiting excellent wire-drawing workability after the hot rolling. On a surface of the wire rod, there is attached a scale having a high adhesion property with which the scale is not detached by strain occurring during transportation to a customer site, and having excellent mechanical descaling property with which the scale is favorably detached during a mechanical descaling process at the customer site.

The present application claims priority based on Japanese Patent Application No. 2009-254172, filed in Japan on Nov. 5, 2009, the contents of which are cited herein by reference.

BACKGROUND ART

For a wire rod obtained by hot rolling a high-carbon steel in the vicinity of eutectoid composition, it is general to perform a descaling process for removing the scale on the surface of the wire rod and a surface treatment process for enhancing sucking of lubricant at the time of wire drawing process, after transportation. Thereafter, the wire drawing process including a patenting treatment is performed one or two times, whereby a high-strength wire having small wire diameter can be obtained. The thus obtained wire is used for a steel cord for a tire, a belt cord for a conveyor belt, a saw wire of a cutting device and the like. Such a high-carbon steel wire rod is required to have a high primary wire drawing property (direct drawability). The primary wire drawing property represents an index indicating the degree of easiness of the wire drawing process in a structure state after a wire rod is hot-rolled. By performing the wire drawing process to the high-carbon steel wire rod having excellent primary wire drawing property, it is possible to manufacture a wire having the small wire diameter without applying an intermediate thermal treatment process.

Patent Document 1 discloses a technique in which a high-carbon steel containing carbon in a range of 0.6 to 1.0% by mass is subjected to four stages of cooling from a finishing temperature. This technique enables the surface of the wire rod to have a pearlite of 95 area % or more. This pearlite has an average nodule diameter P of 30 μm or lower and an average lamella distance S of 100 nm or more, and satisfies the following Equation 1, where P is expressed in μm and S is expressed in nm.

$$F=(350.3/S^{0.5})+(130.3/P^{0.5})-51.7>0 \quad \text{[Equation 1]}$$

In the technique of Patent Document 1, the cooling speed is controlled at an extremely slow speed of 2° C./s or lower in the third stage cooling using air-blast cooling after an hot drawing, thereby adjusting the pearlite block to have the average nodule diameter P of 30 μm or lower and an average lamella distance S of 100 nm or more. This makes it possible to avoid the wire breakage during the high-speed wire-drawing process, and further to prevent the decrease in lifetime of a die. However, this method requires a special configuration for the air-blast cooling. Further, in Patent Document 1, there is no description as to whether the ductility can be maintained without deterioration, even if the reduction of wire-drawing process increases.

For the high-carbon steel wire as described above, its workability is largely affected by a scale (oxide coating) adhered on the surface of the steel wire. Therefore, various studies have been made also on the scale.

The high-carbon steel wire rod such as a wire rod for a steel cord is required to have high productivity, and thus, is produced by using a mechanical descaling process. The wire rod is manufactured by hot rolling, and hence, the scale is adhered on its surface. The scale is required to have the following properties (1) through (3), which favorably contribute to the manufacturing of the wire rod.

(1) Extremely thin so as to be able to avoid scale loss.

(2) Not detached before a mechanical descaling process at customer's site from the viewpoint of prevention of rusting.

(3) The remaining scale ratio is as low as possible after the mechanical descaling process so as not to deteriorate a primary wire drawing property.

In terms of the scale, the adhesion property and the mechanical descaling property are conflicting with each other. More specifically, when the thickness of the scale decreases, the adhesion property increases while the mechanical descaling property deteriorates. Therefore, in the case of forming the scale thin, it is difficult to achieve both high adhesiveness and a high mechanical descaling property.

As a related art, Patent Document 2 discloses a wire rod having the properties (1) and (3) described above. This technique achieves a scale having thin and favorable release properties, by setting a percentage of FeO in the scale at 80% or lower. However, it does not take the property (2) into consideration. Based on experience of the present inventors, it was impossible to achieve the scale that remains unreleased after the hot-rolling process is completed, and that is not released during transportation, even if the percentage is set as described above.

Further, as a technique related to the scale adhesion property, Patent Document 3 discloses a high-carbon steel wire rod containing Ni in a range of 0.05 to 0.15% by mass, and having a degree of surface roughness thereof at 1.5 μm or lower. By using this high-carbon steel wire rod, it is possible to achieve high adhesiveness of secondary scale, and high mechanical descaling property before the wire drawing process. However, in a case of this method, addition of Ni is essential, and the object of this technique cannot be achieved without Ni addition. Further, it is not possible to secure the sufficient adhesiveness, even if Ni is added as a prerequisite. Such a scale property largely affects the primary wire drawing property of the steel material, and hence, there is a demand for development of the high-carbon steel wire rod having both a good steel structure and a favorable scale property.

RELATED ART DOCUMENTS

Patent Documents

Patent Document 1:
Japanese Unexamined Patent Application, First Publication No. 2003-82434
Patent Document 2:
Japanese Unexamined Patent Application, First Publication No. H11-172332
Patent Document 3:
Japanese Unexamined Patent Application, First Publication No. H2-213448

DISCLOSURE OF THE INVENTION

Problems to be Solved by the Invention

An object of the present invention is to provide a high-carbon steel wire rod exhibiting excellent wire-drawing workability after hot rolling, and exhibiting excellent workability with a scale having high adhesion property and excellent mechanical descaling property with which the scale attached on a surface of the wire is not detached by strain occurring during transportation to a customer site, and is favorably removed during a mechanical descaling process at the customer site.

Means for Solving the Problems

To solve the problem described above, the present invention employs the following configurations.

(1) A first aspect of the present invention provides a wire rod that is hot-rolled into a diameter of 4-8 mm, wherein the wire rod contains, in mass %: C: 0.6 to 1.1%; Si: 0.1 to 0.5%; Mn: 0.2 to 0.6%; S: 0.004 to 0.015%; and, Cr: 0.02 to less than 0.05%; with a balance including Fe and inevitable impurities in which P is limited to 0.02% by mass or lower and Al is limited to 0.003% by mass or lower, the wire rod has a pearlite in a surface thereof, and, the wire rod has, in a peripheral portion in a cross section thereof, a {110} crystal plane of ferrite in the pearlite, an accumulation degree of the crystal plane being 1.2 or more.

(2) In the wire rod according to (1) above, in the cross section perpendicular to the longitudinal direction of the wire rod, pearlite block having an equivalent area diameter of pearlite block of less than 15 μm may occupy 50% or lower of an area of the peripheral portion, and, pearlite block having an equivalent area diameter of pearlite block of 35 μm or more may occupy 23% or lower of an area of a central portion.

(3) In the wire rod according to (1) or (2) above, a finishing temperature of the hot-rolling may be 1000° C. or more.

(4) In the wire rod according to (1) or (2) above, a tensile strength TS (MPa) may satisfy Equation 2.

$$200+980\times(C\%\text{ by mass})<TS<400+980\times(C\%\text{ by mass}) \quad \text{[Equation 2]}$$

(5) In the wire rod according to (1) or (2) above, the number of torsion may be 15 turns or more.

(6) In the wire rod according to (1) or (2) above, the wire rod may further contain one or more components of: by mass, B: 0.0001 to 0.0050%; V: 0.03 to 0.10%; Nb: 0.01 to 0.10%; Cu: 0.05 to 0.80%; Ni: 0.05 to 0.20%; and, Ti: 0.001 to 0.1%.

(7) In the wire rod according to (1) or (2) above, the wire rod may have a scale layer on the surface thereof, and an adhesion ratio of the scale layer may be 70% or more.

(8) In the wire rod according to (1) or (2) above, the wire rod may have a scale layer having a thickness in a range of 6 to 15 μm on the surface thereof, and, a remaining scale ratio of the scale layer may be 0.07% or lower when 6% strain is applied.

(9) A second aspect of the present invention provides a wire rod that is hot-rolled into a diameter of 4-8 mm, wherein the wire rod contains, in mass %: C: 0.6 to 1.1%; Si: 0.1 to 0.5%; Mn: 0.2 to 0.6%; S: 0.004 to 0.015%; and, Cr: 0.02 to less than 0.05%; with a balance including Fe and inevitable impurities in which P is limited to 0.02% by mass or lower and Al is limited to 0.003% by mass or lower, and, in the cross section perpendicular to the longitudinal direction of the wire rod, pearlite block having an equivalent area diameter of pearlite block of less than 15 μm occupy 50% or lower of an area of a peripheral portion, and, pearlite block having an equivalent area diameter of pearlite block of 35 μm or more occupy 23% or lower of an area of a central portion.

(10) In the wire rod according to (9) above, the wire rod may have a pearlite in a surface thereof, and, the wire rod has, in a peripheral portion in a cross section thereof, a {110} crystal plane of ferrite in the pearlite, an accumulation degree of the crystal plane being 1.2 or more.

(11) In the wire rod according to (9) or (10) above, a finishing temperature of the hot-rolling may be 1000° C. or more.

(12) In the wire rod according to (9) or (10) above, a tensile strength TS (MPa) may satisfy Equation 3.

$$200+980\times(C\%\text{ by mass})<TS<400+980\times(C\%\text{ by mass}) \quad \text{[Equation 3]}$$

(13) In the wire rod according to (9) or (10) above, the number of torsion may be 15 turns or more.

(14) In the wire rod according to (9) or (10) above, the wire rod may further contain one or more components of: by mass, B: 0.0001 to 0.0050%; V: 0.03 to 0.10%; Nb: 0.01 to 0.10%; Cu: 0.05 to 0.80%; Ni: 0.05 to 0.20%; and, Ti: 0.001 to 0.1%.

(15) In the wire rod according to (9) or (10) above, the wire rod may have a scale layer on the surface thereof, and an adhesion ratio of the scale layer may be 70% or more.

(16) In the wire rod according to (9) or (10) above, the wire rod may have a scale layer having a thickness in a range of 6 to 15 μm on the surface thereof, and, a remaining scale ratio of the scale layer may be 0.07% or lower when 6% strain is applied.

Effect of the Invention

According to the configurations described above, it is possible to obtain a high-carbon wire rod having excellent primary wire-drawing property, adhesion property, and mechanical descaling property, because of favorable ductility in the vicinity of the surface layer.

EMBODIMENTS OF THE INVENTION

Figure 1:
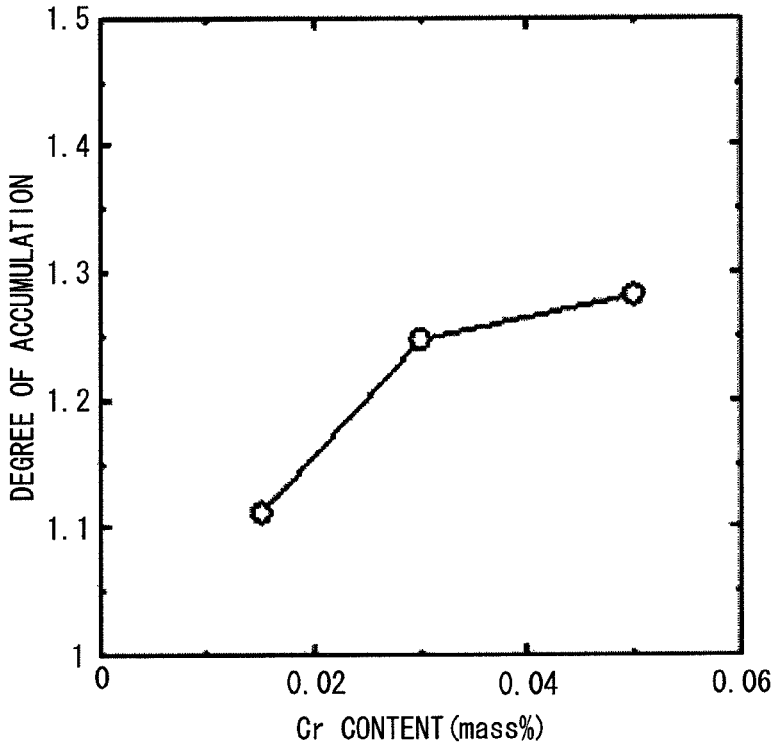
FIG. 1 is a diagram illustrating a relationship between Cr content and an accumulation degree of {110} plane of ferrite.

First, reasons for limiting chemical components that a high-carbon steel wire rod according to one embodiment of the present invention contains will be described.

(1) Essential Components

[C: 0.6 to 1.1% by Mass]

C is an element effective for strengthening the wire rod. In order to obtain high-strength steel wire, the lower limit value is set to 0.6% by mass. Further, in order to suppress a decrease in ductility due to precipitation of pro-eutectoid cementite, the upper limit value thereof is set to 1.1% by mass.

[Si: 0.1 to 0.5% by Mass]

Si is an element necessary for deoxidization of steel. In order to secure the sufficient deoxidization effect, the lower limit value thereof is set at 0.1% by mass. Further, Si is dissolved in the ferrite of the pearlite formed after the heat treatment, and increases the strength of the steel after patenting. On the other hand, Si inhibits the heat treatment. Therefore, the upper limit value thereof is set to 0.5% by mass.

[Mn: 0.2 to 0.6% by Mass]

Mn secures the hardenability of the steel. Therefore, the lower limit value is set at 0.2% by mass. However, adding a large amount of Mn increases the time required for pearlite transformation at the time of the patenting treatment. Therefore, the upper limit value thereof is set at 0.6% by mass.

[S: 0.004 to 0.015% by Mass]

S combines with Mn in the steel to form an inclusion such as MnS. The increase in the content of S leads to a better mechanical descaling property. By adjusting the amount of S and the amount of Cr so as to fall in an appropriate range, this embodiment achieves both the adhesion property and the mechanical descaling property of the scale. In order to secure the mechanical descaling property, the lower limit value thereof is set at 0.004% by mass. Further, S is an impurity element, and hence, the large amount of S decreases the ductility of the drawn wire. For this reason, the upper limit value thereof is set at 0.015% by mass. On the other hand, by decreasing the amount of S, the adhesion property of the scale improves, and the increase of rust is less likely to occur, for example, when the wire rod is stored for a long period of time. Therefore, the amount of S may be set at 0.010% by mass or lower.

[Cr: 0.02 to 0.05% by Mass]

Cr is added because addition of the small amount of Cr increases the wire-drawing workability of the steel, and further improves the adhesion property of the scale. By adding Cr at 0.02% by mass or more, grain diameters of pearlite blocks are favorably distributed, and the crystal orientation of the ferrite can be improved, so that the wire-drawing workability can be improved. Therefore, the lower limit value thereof is set at 0.02% by mass. This makes it possible to obtain favorable wire-drawing workability with which the number of torsion is 15 turns or more. Because the number of texture having a specific orientation increases in the surface layer of the ferrite in the pearlite, the workability thereof could improve, accordingly. However, when 0.05% by mass or more of Cr is added, the number of torsion decreases because the distribution of grain diameters of pearlite blocks deteriorates. For this reason, the upper limit value is set to less than 0.05% by mass.

(2) Inevitable Impurities

[P: 0.02 or Lower]

P is likely to be segregated in the steel. The segregation significantly slows down the speed of eutectoid transformation. Therefore, at the time of air-blast cooling, the eutectoid transformation does not complete, so that a hard martensite is likely to be formed. In order to prevent this, the amount of P is limited to be 0.02% by mass or lower.

[Al: 0.003% by Mass]

Al forms a hard $Al_2O_3$-based inclusion. In order to completely eliminate its effect, the amount of Al is limited to be 0.003% by mass.

(3) Optional Components

[V: 0.03 to 0.10% by Mass]

V is effective for increasing the strength of steel, and hence, may be added to 0.03% by mass or more. However, the excessive amount of V added decreases the ductility, and thus, the upper limit thereof is set to 0.10% by mass.

[B: 0.0001 to 0.0050% by Mass]

B is effective in reducing the γ grain diameter at the time when the wire rod becomes austenite, and in suppressing the non-lamella structure at the time of pearlite transformation, thereby increasing the number of torsion. Therefore, it may be possible to add B at 0.0001% by mass or more. However, when the amount of B added exceeds 0.0050% by mass, the time required for pearlite transformation by thermal treatment increases. Therefore, the upper limit thereof is set at 0.0050% by mass. Note that the number of torsion means the number of twisting of the wire rod at which the twisted wire rod is broken under the torsion testing.

[Nb: 0.01 to 0.10% by Mass]

Nb is effective for increasing the strength of steel. Therefore, it may be possible to add Nb to 0.01% by mass or more. However, the excessive amount of Nb added decreases the ductility. Therefore, the upper limit thereof is set to 0.1% by mass.

[Cu: 0.05 to 0.80% by Mass]

Cu is generally effective in flattening the interface between the scale and the base iron, and in improving the anti-corrosion property (such as corrosion fatigue property). Therefore, from the viewpoint of improving the interfacial property, it may be possible to add Cu to 0.05% by mass or more. Further, from the viewpoint of improving the anti-corrosion property, it may be possible to add Cu to 0.1% by mass or more. However, the excessive amount of Cu added embrittles the steel at the time of hot rolling, and hence, the upper limit thereof is set to 0.8% by mass.

[Ni: 0.05 to 0.20% by Mass]

Ni improves the anti-corrosion property and strength. Therefore, it may be possible to add Ni to 0.01% by mass or more. However, the excessive amount of Ni added embrittles the steel at the time of hot rolling, and hence, the upper limit thereof is set to 0.20% by mass.

[Ti: 0.001 to 0.1% by Mass]

Ti is effective for fixing N in the steel and improving the ductility. Therefore, it may be possible to add Ti at 0.001% by mass or more. However, on the contrary, the excessive amount of Ti added decreases the ductility, and hence, the upper limit thereof is set to 0.1% by mass.

Next, the number of torsion of the high-carbon steel wire rod according to this embodiment will be described.

[Number of Torsion: 15 Turns or More]

In order to favorably secure the primary wire drawing workability of the wire rod, the workability of structures in the surface layer is important, and, is closely related to the number of torsion that the wire rod withstands in a torsion testing. Whether or not the wire rod withstands 15 turns or more is determined based on a torsion testing under JIS-G3525 with 100D (a length of a gage portion 100 times larger than a diameter of the wire) by 20 times (hereinafter, denoted by NT(/100D)). When the number of torsion is less than 15 turns under the torsion testing, it is necessary to increase the {110} plane at the crystal plane of ferrite in the pearlite in the surface portion of the wire rod in the cross-section. When the appearance ratio is measured in terms of the degree of accumulation, 1.2 or more is necessary.

[Accumulation Degree of {110} Plane of Ferrite: 1.2 or More]

The high-carbon steel wire rod according to the present embodiment has 1.2 or more of an accumulation degree of a plane {110} of ferrite in the pearlite observed in the cross-section at the peripheral portion A. Therefore, it is possible to suppress the occurrence of voids due to the shearing force. When the degree of accumulation of {110} plane is low, it is necessary to increase the rotation of crystal in the vicinity of the surface layer, and hence, the wire-drawing workability deteriorates. The degree of accumulation of crystal orientations in the pearlite observed in the cross-section is measured by using a FE-SEM-EBSD method. After a surface to be measured by the EBSD method is obtained through polishing with colloidal silica, measurement is performed on each area formed by 180 μm×300 μm at intervals of 0.3 μm to determine the degree of accumulation of orientations. The degree of accumulation can be calculated by measuring a certain area from the vicinity of the surface layer by an EBSD (Electron Backscatter Diffraction) method.

More specifically, by adding Cr to the wire rod, it is possible to suppress the twisting of the pearlite at the time when the pearlite grows from the recrystallized γ grain through the rolling. This makes it possible to improve the degree of accumulation of the {110} plane of ferrite, thereby eliminating the portion where the number of torsion is low.

By adjusting the structure as described above, the number of torsion and the wire-drawing workability can be improved.

It should be noted that FIG. 1 illustrates a relationship between the Cr content and the degree of accumulation of the {110} plane of ferrite. From this drawing, it can be understood that it is effective to control Cr in the range of 0.02 to 0.05% by mass in order to adjust the degree of accumulation.

[Grain Diameter of Pearlite Block]

The grain diameter distribution of pearlite blocks in the hot-rolled wire rod subjected to a stelmor cooling process varies from the center to the surface layer of the wire rod. Occurrence of voids during the working relates to an area ratio (occupancy ratio) of the grain diameter of pearlite block in a cross-sectional plane perpendicular to the longitudinal direction of the wire rod.

Figure 2:
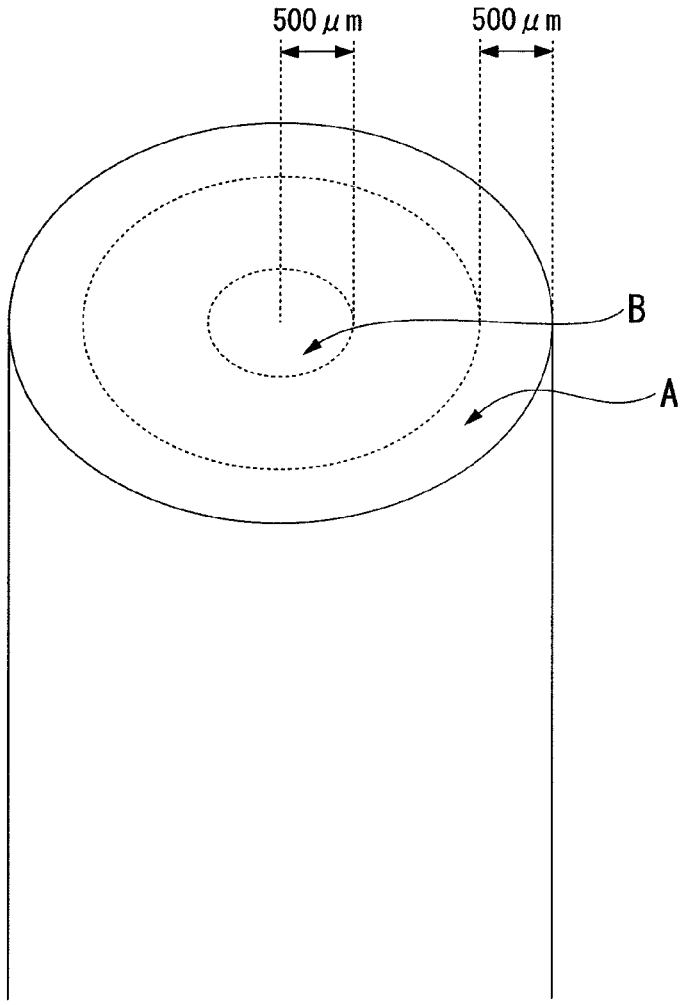
FIG. 2 is a diagram illustrating a peripheral portion A and a central portion B in a cross section perpendicular to a longitudinal direction of a wire rod.

FIG. 2 illustrates a peripheral portion A and a central portion B in a cross-sectional plane perpendicular to the longitudinal direction of the wire rod. In this specification, as illustrated in FIG. 2, the peripheral portion A is defined as an area within a depth of 500 μm from the surface of the wire rod, and the central portion B is defined as an area within 500 μm from the center of the wire rod in the radial direction.

Figure 3:
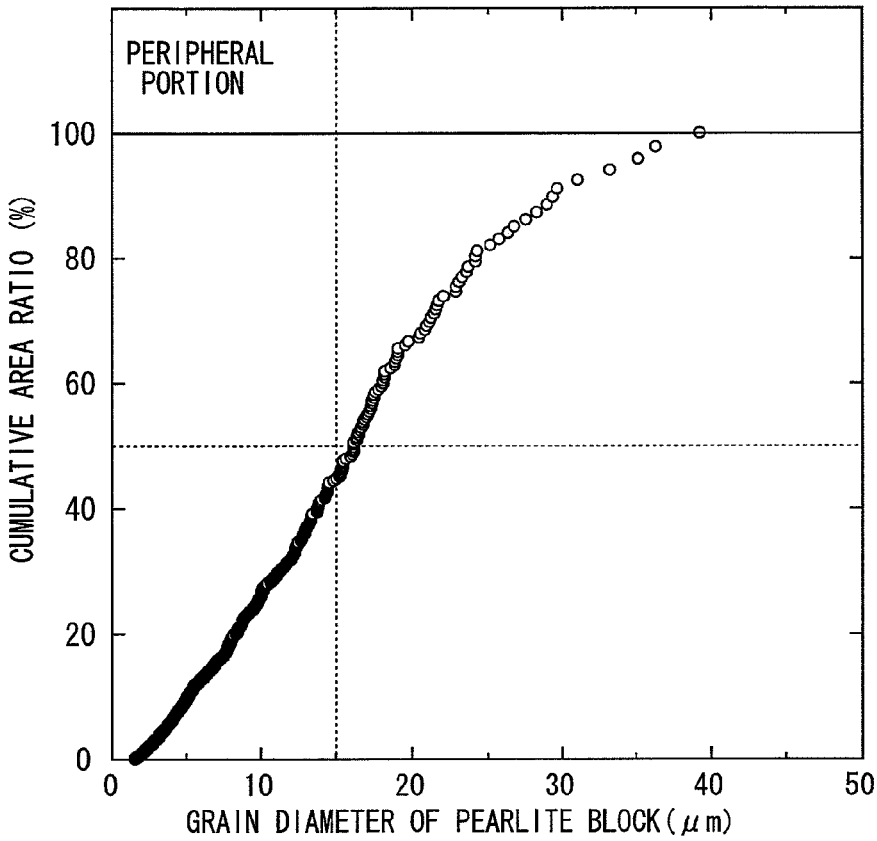
FIG. 3 is a graph illustrating a relationship between a diameter of a pearlite block grain and a cumulative area ratio in the peripheral portion A in connection with Examples.

In the peripheral portion A of the wire rod, in a case where the area ratio (occupancy ratio) of the grain having a grain diameter of the pearlite block at less than 15 μm exceeds 50%, the occurrence of void increases at the time when transformation temperature decreases during transformation of the structures from γ to pearlite in the adjustment cooling after hot-rolling. Therefore, it is preferable that the area in which the grains having a diameter of less than 15 μm occupy is 50% or lower. FIG. 3 illustrates changes of cumulative area ratio of the pearlite block grain diameter in the peripheral portion A.

Figure 4:
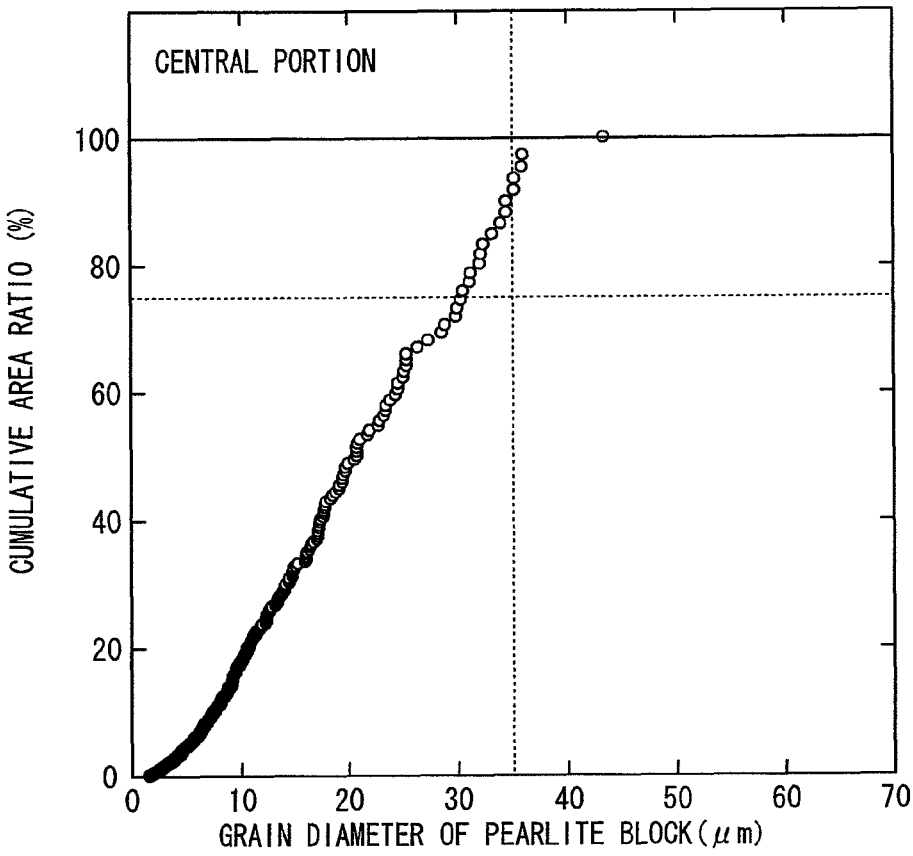
FIG. 4 is a graph illustrating a relationship between a diameter of a pearlite block grain and a cumulative area ratio in the central portion B in connection with Examples.

In the central portion B of the wire rod, in a case where the area ratio (occupancy ratio) of the grain having a grain diameter of the pearlite block at 35 μm or more exceeds 23%, chevron cracks are likely to occur during the wire drawing process. Therefore, it is preferable that the ratio of the area in which the grains having a pearlite block grain diameter at 35 μm or more occupy is 23% or lower in the central portion B. FIG. 4 illustrates changes of cumulative area ratio of the pearlite block grain diameter in the central portion B.

To adjust the grain diameter of the pearlite block, it is effective to adjust the Cr content in a range of 0.02 to 0.05% by mass, and make the wire rod contain O in a range of 18 to 30 ppm and N in a range of 10 to 40 ppm.

Table 1 illustrates a ratio (area ratio) of grain diameter of the pearlite block.

TABLE 1

| | Area ratio of grain with diameter of less than 15 μm | | | Area ratio of grain with diameter of 35 μm or more | | |
|---|---|---|---|---|---|---|
| Cr (mass %) | Peripheral portion | Quarter portion | Central portion | Peripheral portion | Quarter portion | Central portion |
| 0.015 | 51.2 | 35.3 | 26.3 | 4.4 | 12.3 | 22.4 |
| 0.03 | 44.4 | 38.4 | 32.5 | 6.0 | 14.7 | 10.1 |
| 0.05 | 50.4 | 28.9 | 22.9 | 1.9 | 14.7 | 25.3 |

[TS of Wire Rod]

TS of the wire rod is an important property to determine the degree of stress acting during deformation. Therefore, in addition to control the texture and the grain diameter of the pearlite block, it is necessary to adjust the tensile strength to be in a certain range. The tensile strength is largely depend mainly on the C content. The lower tensile strength makes pearlite blocks coarser. On the other hand, the higher tensile strength makes the work hardening larger, which makes it possible to speed up the working. Therefore, the tensile strength is adjusted so as to satisfy the following Equation 4.

$$200+980\times(C\%\text{ by mass})<TS<400+980\times(C\%\text{ by mass}) \quad \text{[Equation 4]}$$

The TS can be adjusted, for example, by adjustment of temperature during coiling and adjustment of volume of air during the stelmor cooling process. In general, the higher coiling temperature yields the higher TS, and the larger air volume during the stelmor cooling process yields the higher strength.

Next, the scale will be described.

[Thickness of Scale: 6 to 15 μm]

In the high-carbon steel wire rod according to the present embodiment, the thickness of the scale adhered after hot rolling is adjusted in a range of 6 to 15 μm, or 6 to 12 μm. When the thickness of the scale is less than 6 μm, the scale is undesirably thin, which worsens the mechanical descaling property. The reason for adjusting the thickness of the scale at 15 μm or lower is that the scale loss increases when the thickness is 15 μm or more. Therefore, the thickness may be adjusted to be 12 μm or lower. The scale thickness adhered after the hot rolling may be adjusted by adjustment of finishing temperature of the rolling process and coiling temperature.

[Scale Adhesion Ratio]

The scale adhesion ratio is accurately obtained such that: the entire length of the wire rod of five rings or more is analyzed by using an image analyzer to obtain an area in which the scale is adhered; and the ratio of the scale adhesion area to the entire analyzed area is obtained. At this time, measurement is performed on both sides so as to measure the entire circumference of the wire rod.

As a simpler method without using the image analyzer, the scale adhesion ratio is obtained such that: the amount of adhesion is visually determined; the entire length of at least five rings is visually observed; and, an area in which the scale is not detached is measured in 10% units. This determination is made three times by using different five rings to obtain the average value.

In the wire rod according to this embodiment, it may be possible to adjust the adhesion ratio in the scale layer at 70% or more, or 80% or more. In a case of 70% or more, the rust is likely to occur from a portion where the scale is partially detached, and hence, it is not possible to maintain the favorable wire-drawing workability only by the mechanical descaling. By setting the adhesion ratio at 80% or more, the area where the rust occurs becomes narrow, and hence, it is possible to prevent the ductility from largely reducing.

[Remaining Scale Ratio When 6% Strain is Applied: 0.07% or Lower]

In the wire rod according to this embodiment, the remaining scale ratio is 0.07% or lower when 6% strain is applied. When the remaining scale ratio exceeds 0.07% by mass, the scale portion generates heat through the wire-drawing process, and deteriorates the wire properties, possibly resulting in breakage of the wire.

[Finishing Temperature of Hot Rolling: 1000° C. or More]

When the finishing temperature of the hot rolling is low, the accumulation degree of the texture in the peripheral portion A of the wire rod becomes less than 1.2, which deteriorates the wire-drawing workability. Therefore, it is preferable for the finishing temperature of the hot rolling to be 1000° C.

According to the configuration described above, it is possible to obtain the wire rod having favorable primary wire-drawing workability with which the number of torsion is 15 turns or more after the hot rolling. At the same time, the scale adhered is not detached during conveying or transportation of the wire rod, but is detached without remaining on the wire rod when a certain degree of strain or more such as the mechanical descaling is applied, thereby easily obtaining the high primary wire-drawing workability.

EXAMPLE

First Example

Table 2 shows the amounts of C, Si, Mn, P, S, Al and Cr in percent by mass, and the amounts of N and O in units of ppm.

Steels having compositions shown in Table 2 are melted, and are subjected to continuous casting into bloom to obtain a 122 mm-square billet. The billet is hot-rolled at a finishing temperature of 1000° C. or more into a wire rod with a diameter of 5.5 mm. Then, the obtained wire rod is subjected to the stelmor cooling process.

TABLE 2

| | C (%) | Si (%) | Mn (%) | P (%) | S (%) | Al (%) | Cr (%) | N (ppm) | O (ppm) |
|---|---|---|---|---|---|---|---|---|---|
| Comparative Example A | 0.818 | 0.185 | 0.50 | 0.006 | 0.009 | 0.001 | 0.015 | 22 | 22 |
| Example B | 0.814 | 0.175 | 0.50 | 0.009 | 0.009 | 0.001 | 0.030 | 22 | 24 |
| Comparative Example C | 0.822 | 0.173 | 0.50 | 0.008 | 0.009 | 0.001 | 0.050 | 23 | 21 |
| Example D | 0.821 | 0.192 | 0.48 | 0.008 | 0.010 | 0.001 | 0.039 | 24 | 27 |
| Example E | 0.821 | 0.194 | 0.48 | 0.008 | 0.004 | 0.001 | 0.022 | 25 | 26 |

Table 3 shows mechanical properties of the hot-rolled wire rod. It can be understood that, although TS (tensile strength), RA (reduction of area), EL (total elongation) and NT (number of torsion) are almost the same, the low value—15 turns or lower in the torsion testing, which was conducted 20 consecutive samples—cannot be found in the steels according to the present invention. NT is the number of torsion until the steel is broken. NT(/100D) in Table 3 indicates an average number of torsion when the torsion testing was conducted 20 times with samples having a gage length 100 times larger than the diameter of the wire.

TABLE 3

| | TS (MPa) | RA (%) | EL (%) | NT (/100D) | Number of torsion: less than 15 turns |
|---|---|---|---|---|---|
| Comparative Example A | 1113 | 42.1 | 10.2 | 25.7 | 2/20 |
| Example B | 1121 | 45.1 | 11.1 | 25.7 | 0/20 |
| Comparative Example C | 1119 | 42.9 | 12.9 | 26.6 | 2/20 |
| Example D | 1134 | 41.8 | 11.6 | 24.8 | 0/20 |
| Example E | 1118 | 42.3 | 11.5 | 25.7 | 0/20 |

Figure 5:
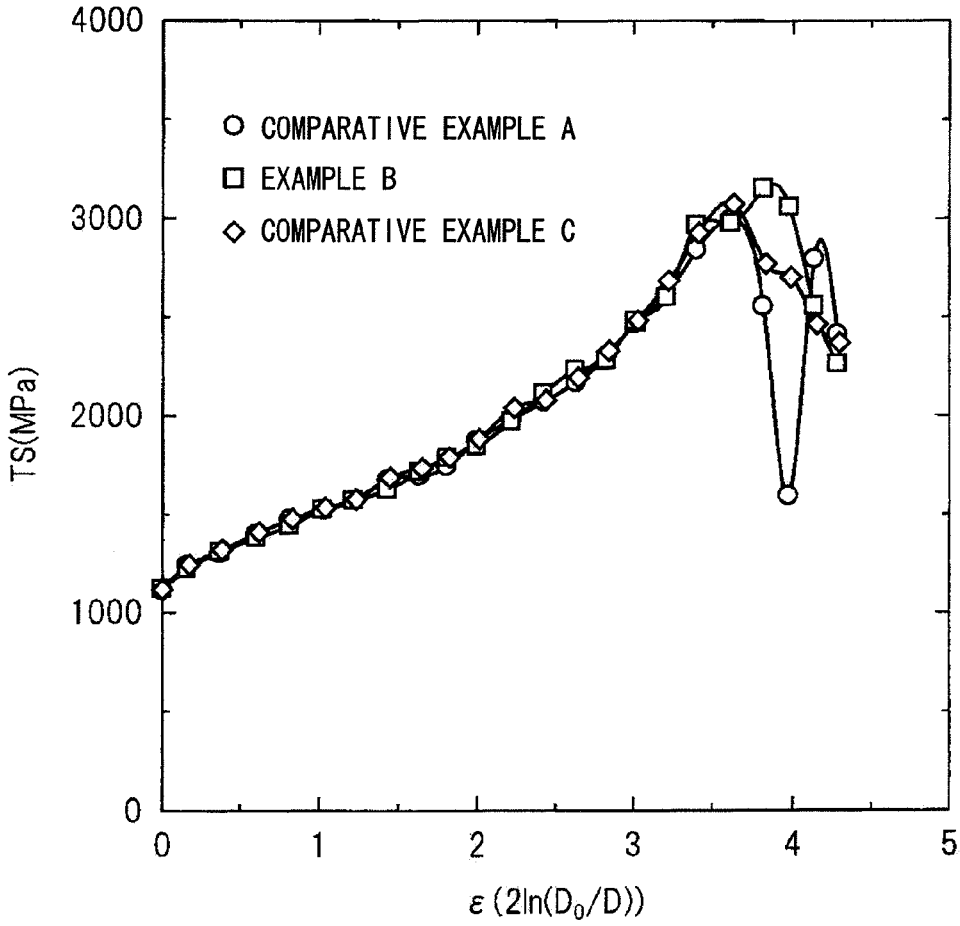
FIG. 5 is a diagram illustrating a relationship between the amount of wire drawing and tensile strength.

The hot-rolled wire rods were subjected to a drawing process using a single block drawing machine, and the results thereof are shown in FIG. 5. In FIG. 5, the horizontal axis represents the amount of wire drawings $\epsilon$ ($2\times1$ $n(D_0/D)$), and the vertical axis represents the tensile strength TS (MPa). In Examples, it can be understood that a decrease in the strength is suppressed in a case where the process amount of wire drawing is large, as compared with Comparative Examples. This is because the steel of Example has large elongation, and is a uniform material.

Next, Table 4 shows mechanical properties of the wire rod after drawn from the diameter of 5.5 mm to the diameter of 1.1 mm. Although large difference in the TS (tensile strength) and RA (reduction of area) does not exist between Examples B, D and E, and Comparative Examples A and C, Examples exhibit slightly larger values of the EL (total elongation) and NT (number of torsion). Further, regarding the torsion testing, delamination (longitudinal crack) did not occur in Examples, while delamination occurred in Comparative Examples.

TABLE 4

| Type of steel | Wire diameter (mm) | TS (MPa) | RA (%) | EL (%) | NT (/100D) | Delamination |
|---|---|---|---|---|---|---|
| Comparative Example A | 1.09 | 2611 | 47.5 | 2.78 | 28.9 | Exist |
| Example B | 1.09 | 2597 | 47.2 | 2.65 | 32.4 | Not exist |
| Comparative Example C | 1.09 | 2683 | 45.9 | 2.82 | 26.2 | Exist |
| Example D | 1.09 | 2625 | 46.7 | 2.69 | 31.5 | Not exist |
| Example E | 1.09 | 2644 | 46 | 2.73 | 32.3 | Not exist |

Second Embodiment 122 mm-square billets formed by steel having compositions shown in Table 5 were hot-rolled into wire rods with a diameter of 5.5 mm at a finishing temperature of 1000° C. or more. The coiling temperature is adjusted to be 830° C. or more and 930° C. or less depending on the steel composition, and the strongest stelmor cooling process that the existing facility can apply was performed. Table 5 shows Examples 1 to 15 and Comparative Examples 16 to 19. Note that underlines are applied to the values of Comparative Examples that fall outside of the range specified in the present invention.

TABLE 5

| | C (%) | Si (%) | Mn (%) | P (%) | S (%) | Al (%) | Cr (%) | B (%) | V (%) | Nb (%) | Cu (%) | Ni (%) | Ti (%) |
|---|---|---|---|---|---|---|---|---|---|---|---|---|---|
| Example 1 | 0.6 | 0.2 | 0.5 | 0.01 | 0 | 0 | 0 | — | — | — | — | — | — |
| Example 2 | 0.7 | 0.2 | 0.5 | 0.01 | 0.01 | 0 | 0 | — | — | — | — | — | — |
| Example 3 | 0.8 | 0.2 | 0.5 | 0.01 | 0.01 | 0 | 0 | — | — | — | — | — | — |
| Example 4 | 0.9 | 0.2 | 0.5 | 0.01 | 0.01 | 0 | 0 | — | — | — | — | — | — |
| Example 5 | 1 | 0.2 | 0.5 | 0.01 | 0.01 | 0 | 0 | — | — | — | — | — | — |
| Example 6 | 0.9 | 0.2 | 0.5 | 0.01 | 0.01 | 0 | 0 | — | — | — | — | — | — |
| Example 7 | 1 | 0.2 | 0.5 | 0.01 | 0 | 0 | 0 | — | — | — | — | — | — |
| Example 8 | 1 | 0.2 | 0.2 | 0.01 | 0.01 | 0 | 0 | — | — | — | — | — | — |
| Example 9 | 0.8 | 0.2 | 0.5 | 0.01 | 0.01 | 0 | 0 | 0.0002 | — | — | — | — | — |
| Example 10 | 0.8 | 0.2 | 0.2 | 0.01 | 0.01 | 0 | 0 | — | — | — | — | 0.1 | — |
| Example 11 | 0.8 | 0.2 | 0.5 | 0.01 | 0.01 | 0 | 0 | — | — | 0 | — | — | — |
| Example 12 | 0.8 | 0.2 | 0.4 | 0.01 | 0.01 | 0 | 0 | — | — | — | 0.1 | — | — |
| Example 13 | 0.8 | 0.2 | 0.4 | 0.01 | 0.01 | 0 | 0 | — | 0 | — | — | — | — |
| Example 14 | 0.8 | 0.2 | 0.5 | 0.01 | 0.01 | 0 | 0 | — | — | — | — | — | 0 |
| Example 15 | 0.8 | 0.2 | 0.5 | 0.01 | 0 | 0 | 0 | 0.0002 | — | — | — | — | 0 |
| Comparative Example 16 | 0.8 | 0.2 | 0.5 | 0.01 | 0.01 | 0 | 0 | — | — | — | — | — | — |
| Comparative Example 17 | 0.8 | 0.2 | 0.5 | 0.01 | 0.01 | 0 | 0.1 | — | — | — | — | — | — |
| Comparative Example 18 | 0.8 | 0.2 | 0.5 | 0.01 | 0.02 | 0 | 0 | — | — | — | — | — | — |
| Comparative Example 19 | 0.8 | 0.2 | 0.5 | 0.01 | 0 | 0 | 0 | — | — | — | — | — | — |
| Comparative Example 20 | 0.8 | 0.2 | 0.5 | 0.01 | 0 | 0 | 0 | | | | | | |

Table 6 shows the results of evaluation for the obtained wire rods in terms of coiling temperature, mechanical properties (tensile strength TS and reduction of area RA), and characters of scale (thickness, adhesion ratio, remaining scale ratio).

The adhesion ratio was obtained by performing visual observation on the surface of the wire rods, and was indicated by an area ratio (occupancy ratio) in which the scale on the surface is detached. The evaluations were made on a T portion, an M portion and a B portion, and arithmetical mean thereof was calculated. The T portion, the M portion and the B portion represent a top portion, a middle portion and a bottom end portion of a coil to be wire-drawn, respectively.

The thickness of the scale was obtained from optical micrographs of cross sections of surface layers of the wire rods.

The remaining scale ratio was measured such that a mass (W2) of a wire rod after the scale is completely removed by 16% hydrochloric acid without applying tension is subtracted from a mass (W1) of a wire rod after a 300 mm wire rod (gage length: 200 mm) is pulled at a rate of 25 mm/min to apply 6% strain, and the thus obtained value is applied to the following Equation 5.

$$\text{Remaining scale ratio (\%)}=(W1-W2)/W2\times 100 \quad \text{[Equation 5]}$$

TABLE 6

| | Finishing temperature of rolling (° C.) | Coiling temperature (° C.) | TS (MPa) | RA (%) | Scale thickness (μm) | Adhesion ratio (%) | Remaining scale ratio (%) |
|---|---|---|---|---|---|---|---|
| Example 1 | 1000° C. | 860 | 967 | 52 | 8 | 86 | 0.03 |
| Example 2 | 1000° C. | 870 | 1010 | 48 | 10 | 85 | 0.04 |
| Example 3 | 1000° C. | 890 | 1082 | 46 | 12 | 84 | 0.03 |
| Example 4 | 1000° C. | 860 | 1165 | 40 | 9 | 82 | 0.04 |
| Example 5 | 1000° C. | 870 | 1240 | 37 | 9 | 88 | 0.04 |
| Example 6 | 1000° C. | 890 | 1091 | 42 | 11 | 84 | 0.04 |
| Example 7 | 1000° C. | 860 | 1189 | 42 | 8 | 82 | 0.05 |
| Example 8 | 1000° C. | 870 | 1203 | 29 | 13 | 87 | 0.05 |
| Example 9 | 1000° C. | 890 | 1063 | 44 | 14 | 88 | 0.02 |
| Example 10 | 1000° C. | 860 | 1077 | 43 | 9 | 86 | 0.02 |
| Example 11 | 1000° C. | 870 | 1087 | 42 | 10 | 84 | 0.03 |
| Example 12 | 1000° C. | 890 | 1090 | 43 | 9 | 83 | 0.03 |
| Example 13 | 1000° C. | 860 | 1091 | 42 | 9 | 88 | 0.02 |
| Example 14 | 1000° C. | 870 | 1084 | 42 | 10 | 87 | 0.02 |
| Example 15 | 1000° C. | 890 | 1095 | 44 | 13 | 89 | 0.04 |

TABLE 6-continued

| | Finishing temperature of rolling (° C.) | Coiling temperature (° C.) | TS (MPa) | RA (%) | Scale thickness (μm) | Adhesion ratio (%) | Remaining scale ratio (%) |
|---|---|---|---|---|---|---|---|
| Comparative Example 16 | 1000° C. | 880 | 1087 | 42 | 10 | 48 | 0.05 |
| Comparative Example 17 | 1000° C. | 880 | 1100 | 43 | 11 | 90 | 0.08 |
| Comparative Example 18 | 1000° C. | 880 | 1077 | 45 | 11 | 62 | 0.05 |
| Comparative Example 19 | 1000° C. | 880 | 1058 | 44 | 10 | 90 | 0.08 |
| Comparative Example 20 | 900° C. | 880 | 1044 | 44 | 8 | 85 | 0.06 |

It can be known that Examples 1-15 exhibit a high adhesion ratio and low remaining scale ratio.

Example 16 exhibits a low adhesion ratio of 42% because the Cr content is lower than the range specified in the present invention.

Comparative Example 17 exhibits slightly higher TS and higher remaining scale ratio as compared with those having almost the same steel compositions, because the Cr content is higher than the range specified in the present invention.

Comparative Example 18 exhibits low adhesion ratio of 62%, because the S content is higher than the range specified in the present invention.

Comparative Example 19 exhibits high remaining scale ratio of 0.08, because the S content is lower than the range specified in the present invention.

Although satisfying the scale property, Comparative Example 20 exhibits 1.2 or lower of the accumulation degree of the texture in the peripheral portion A of the wire rod and low wire-drawing workability, because the finishing temperature of the hot-rolling process is low.

It should be noted that, of Examples 1-15, Examples 9-15, to which optional components according to the preferred embodiment of the present invention are added, obtain the following additional, desirable properties.

Example 9 exhibits improved strength because B, which is one of the optional components, is added within the specified range.

Example 10 exhibits improved anti-corrosion property because Ni, which is one of the optional components, is added within the specified range.

Example 11 exhibits improved strength because Nb, which is one of the optional components, is added within the specified range.

Example 12 exhibits improved corrosion fatigue property because Cu, which is one of the optional components, is added within the specified range.

Example 13 exhibits improved strength because V, which is one of the optional components, is added within the specified range.

Example 14 exhibits improved ductility because Ti, which is one of the optional components, is added within the specified range.

Example 15 exhibits improved ductility because B and Ti, which are among the optional components, are added within the specified range.

INDUSTRIAL APPLICABILITY

According to the present invention, it is possible to obtain a wire rod having, on a surface thereof, a scale having high adhesion property with which the scale is not detached by strain occurring during transportation to a customer site, and having excellent mechanical descaling property with which the scale is favorably detached during a mechanical descaling process at the customer site. Therefore, the present invention sufficiently has industrial applicability.

| REFERENCE SIGNS LIST | |
|---|---|
| A: | Peripheral portion |
| B: | Central portion |

The invention claimed is:

1. A wire rod that is hot-rolled into a diameter of 4-8 mm, wherein the wire rod contains, in mass %:

C: 0.6 to 1.1%;

Si: 0.1 to 0.5%;

Mn: 0.2 to 0.6%;

S: 0.004 to 0.015%; and

Cr: 0.03 to less than 0.05%;

with a balance including Fe and inevitable impurities in which P is limited to 0.02% by mass or lower and Al is limited to 0.003% by mass or lower, wherein the wire rod has a pearlite in a peripheral portion which is defined as an area within a depth of 500 μm from a surface of the wire rod, and wherein a crystal plane of a ferrite in the pearlite in the peripheral portion has, in a cross section of the wire rod, a {110} crystal plane having an accumulation degree of the crystal plane being 1.25 or more, and a tensile strength TS (MPa) of the wire rod satisfies $$200+980\times(C\%\text{ by mass})<TS<400+980\times(C\%\text{ by mass}) \quad \text{(Equation 1).}$$

2. The wire rod according to claim 1, wherein a finishing temperature of the hot-rolling is 1000° C. or more.

3. The wire rod according to claim 1, wherein the number of torsion is 15 turns or more.

4. The wire rod according to claim 1, wherein the wire rod further contains one or more components of: by mass %, B: 0.0001 to 0.0050%;

V: 0.03 to 0.10%;

Nb: 0.01 to 0.10%;

Cu: 0.05 to 0.80%;

Ni: 0.05 to 0.20%; and

Ti: 0.001 to 0.1%.

5. The wire rod according to claim 1, wherein the wire rod has a scale layer on the surface thereof, and an adhesion ratio of the scale layer is 70% or more.

6. The wire rod according to claim 1, wherein the wire rod has a scale layer having a thickness in a range of 6 to 15 μm on the surface thereof, and, a remaining scale ratio of the scale layer is 0.07% or lower when 6% strain is applied.

* * * * *